US011250820B2

(12) United States Patent
Tanaka

(10) Patent No.: US 11,250,820 B2
(45) Date of Patent: Feb. 15, 2022

(54) STOPPER RAIL FOR SILENT PIANO

(71) Applicant: KABUSHIKI KAISHA KAWAI GAKKI SEISAKUSHO, Hamamatsu (JP)

(72) Inventor: Kousuke Tanaka, Hamamatsu (JP)

(73) Assignee: KABUSHIKI KAISHA KAWAI SEISAKUSHO, Hamamatsu (JP)

( * ) Notice: Subject to any disclaimer, the term of this patent is extended or adjusted under 35 U.S.C. 154(b) by 0 days.

(21) Appl. No.: 17/215,708

(22) Filed: Mar. 29, 2021

(65) Prior Publication Data

US 2021/0304710 A1 Sep. 30, 2021

(30) Foreign Application Priority Data

Mar. 30, 2020 (JP) ..... JP2020-061013

(51) Int. Cl.
*G10D 3/18* (2020.01)
*G10C 3/166* (2019.01)
*G10C 3/18* (2006.01)

(52) U.S. Cl.
CPC ..... *G10C 3/166* (2013.01); *G10C 3/18* (2013.01)

(58) Field of Classification Search
CPC . G10C 3/166; G10C 3/18; G10C 3/00; G10D 3/00
See application file for complete search history.

(56) References Cited

U.S. PATENT DOCUMENTS 5,616,880 A * 4/1997 Hayashida ..... G10C 5/10 84/719

FOREIGN PATENT DOCUMENTS

JP 2010-134401 6/2010

* cited by examiner

*Primary Examiner* — Kimberly R Lockett
(74) *Attorney, Agent, or Firm* — Lewis Roca Rothgerber Christie LLP

(57) ABSTRACT

A stopper rail of a silent piano, which can make collision noise generated when a hammer shank collides against the stopper rail, blurred in the sense of pitch thereof and difficult to be recognized by the human ear, in a silent performance mode. In this mode, the stopper rail is contacted by the hammer shank of a hammer being pivotally moved to stop pivotal movement of the hammer. The stopper rail includes a rail body having a predetermined flexural rigidity allowing vibration, a first cushion provided on one surface of the hammer shank, for being contacted by the hammer shank being pivotally moved, and a vibration suppressing portion provided on an opposite surface of: the rail body to the first surface so as to apply a load to the rail body to suppress vibration of the rail body when the hammer shank contacts the rail body.

5 Claims, 5 Drawing Sheets

STOPPER RAIL FOR SILENT PIANO

CROSS-REFERENCE TO RELATED APPLICATION(S)

This application claims priority to Japanese Patent Application Number 2020-061013, filed on Mar. 30, 2020, the entire contents of which are incorporated herein by reference.

BACKGROUND OF THE INVENTION

Field of the Invention

The present invention relates to a silent piano capable of being played while switching between a normal performance mode in which a hammer being pivotally moved in accordance with depression of a key is allowed to strike a string and a silent performance mode in which the hammer is blocked from striking the string, and particularly to a stopper rail with which a hammer shank of the hammer being pivotally moved is brought into contact to stop pivotal movement of the hammer.

Description of the Related Art

Conventionally, as this kind of silent piano, there has been known, for example, one disclosed in Japanese Laid-Open Patent Publication (Kokai) No. 2010-134401 already filed by the present applicant. This stopper rail is disposed between hammers and strings and is capable of moving between a string striking-allowing position for allowing hammers to strike strings in the normal performance mode and a string striking-blocking position for blocking the hammers to strike the strings in the silent performance mode. Further, the stopper rail includes a rail body extending in a left-right direction, a cushion laminated on a front surface of the rail body on a side toward the hammers, and a vibration control member laminated on a rear surface of the rail body on a side toward the strings. The rail body is formed by a metal material, such as a steel plate, and the cushion is formed by a resilient material, such as foamed urethane. Further, the vibration control member is formed by a material having cushioning properties, such as foamed low-repulsion foamed urethane and rubber.

When the performance mode is switched from the normal performance mode to the silent performance mode, the stopper rail described above is moved from the string striking-allowing position to the string striking-blocking position. As a result, in the silent performance mode, a hammer shank of a hammer being pivotally moved in accordance with key depression is brought into contact with the stopper rail, which blocks the hammer from striking the string so that generation of a piano tone is prevented. Also in this case, when the hammer shank collides against the stopper rail, vibration of the rail body is absorbed by the cushion and the vibration control member provided on the front and rear surfaces of the rail body, whereby generation of noise caused by the collision is suppressed.

However, the stopper rail is sometimes incapable of sufficiently suppressing the vibration of the rail body only by absorption thereof by the cushion and the vibration control member, and in such cases, generation noise is not sufficiently suppressed, either. To avoid the inconvenience, it is required to suppress the vibration of the rail body. As a method therefor, it is envisaged to increase the weight of the rail body itself and increase the rigidity thereof.

However, in a case where the weight of the rail body is increased by increasing the thickness thereof or the flexural rigidity of the rail body is increased by providing a rib on the rail body to increase the second moment of area thereof, when a hammer shank collides against the stopper rail, a relatively high-pitched collision noise is generated. Such a collision noise is relatively clear in the sense of pitch and hence is easily recognized by the human ear. When the silent piano is played in the silent performance mode, the collision noise is hardly obtrusive to the player, who listens to the performance sound using a head phone, whereas to a person near the silent piano, the collision noise, which is repeatedly generated by key depression performed during performance and is relatively clear in the sense of pitch, is sometimes obtrusive. Therefore, the conventional stopper rail described above has room for improvement.

SUMMARY OF THE INVENTION

It is an object of the present invention to provide a stopper rail for a silent piano, which is capable of making collision noise generated when a hammer shank collides against the stopper rail blurred and difficult to be recognized by the human ear, in the silent performance mode, and consequently resolving the problem of obtrusiveness of the collision noise.

To attain the above object, the present invention provides a stopper rail for a silent piano that can be played while switching between a normal performance mode in which a hammer being pivotally moved in accordance with depression of a key is allowed to strike a string and a silent performance mode in which the hammer is blocked from striking the string, the stopper rail having a hammer shank of the hammer being pivotally moved brought into contact therewith to block further pivotal movement of the hammer, in the silent performance mode, the stopper rail comprising a rail body that extends in a direction of side-by-side arrangement of a plurality of the hammers of the silent piano and has a predetermined flexural rigidity allowing vibration, a first cushion which is provided on a first surface of of the rail body on a side toward the hammer shank and with which the hammer shank is brought into contact, and a vibration suppressing portion which is provided on a second surface of the rail body opposite to the first surface so as to apply a load to the rail body, for suppressing vibration of the rail body when the hammer shank is brought into contact with the rail body.

According to this construction, in the silent piano capable of being played while switching between the normal performance mode and the silent performance mode, when in the silent performance mode, the hammer shank being pivotally moved in accordance with key depression is brought into contact with the stopper rail, whereby further pivotal movement of the hammer is blocked. This blocks the hammer from striking a string, so that generation of an acoustic piano tone is prevented. The stopper rail has a rail body extending in a direction of side-by-side arrangement of a plurality of hammers of the silent piano, and the first cushion is provided on the first surface of the rail body on a side toward the hammer shank. With this, when the hammer shank of the hammer being pivotally moved is brought into contact with the stopper rail, the hammer is brought into contact with the first surface of the rail body via the first cushion, and hence, it is possible to reduce noise generated by collision, compared with a case where the hammer shank directly collides against the rail body.

Further, the rail body of the stopper rail has a predetermined flexural rigidity allowing vibration. More specifically, the rail body itself has a relatively low flexural rigidity, and is liable to vibrate depending on a manner of collision of the hammer shank. In the rail body, the vibration suppressing portion is provided on the second surface thereof opposite to the first surface so as to apply a load to the rail body. By suppressing vibration of the rail body which is originally liable to vibrate by the vibration suppressing portion, it is possible to make collision noise generated when the hammer shank collides against the stopper rail blurred in the sense of pitch thereof and difficult to be recognized by the human ear. As a result, it is possible to resolve the problem of obrusiveness of the collision noise to a person near the silent piano.

Preferably, the vibration suppressing portion extends along a substantial entirety of the rail body in a longitudinal direction of the rail body and has a weight causing gravity of the weight to act as the load on the rail body.

According to this construction, as the vibration suppressing portion, the weight extending along the substantial entirety of the rail body in the longitudinal direction of the rail body is used to cause the gravity of the weight to act as the load on the rail body, whereby it is possible to effectively suppress vibration of the rail body.

More preferably, the vibration suppressing portion further includes a second cushion provided between the rail body and the weight.

According to this construction, since the second cushion is provided between the rail body and the weight, it is possible to reduce noise generated between the rail body and the weight when the hammer shank collides against the stopper rail.

Preferably, the vibration suppressing portion has a tension mechanism that causes tension to act as the load on the rail body.

According to this construction, the tension mechanism is used as the vibration suppression portion, whereby the tension generated by the tension mechanism is caused to act as the load on the rail body. This makes it possible to effectively suppress vibration of the rail body.

More preferably, the tension mechanism includes a tension generating plate that extends along a substantial entirety of the rail body in a longitudinal direction of the rail body, for generating tension, a pair of fixing screws for screwing opposite ends of the tension generating plate to opposite ends of the rail body in the longitudinal direction of the rail body, respectively, and an interposed portion which is interposed between the rail body and the tension generating plate and cooperates with the tension generating plate by fastening of the pair of fixing screws to cause the tension to act on the rail body.

According to this construction, by fastening the pair of fixing screws in n state in which the interposed portion is interposed between the rail body and the tension generating plate, the opposite ends of the tension generating plate are screwed to the opposite ends of the rail body in the longitudinal direction of the rail body. This makes it possible to easily cause the tension to act on the rail body by cooperation of the tension generating portion screwed to the rail body and the interposed portion interposed therebetween. Further, by changing the shape and size of the interposed portion, it is possible to easily adjust the tension acting on the rail body.

The above and other objects, features, and advantages of the present invention will become more apparent from the following detailed description taken in conjunction with the accompanying drawings.

DETAILED DESCRIPTION OF PREFERRED EMBODIMENTS

Figure 1:
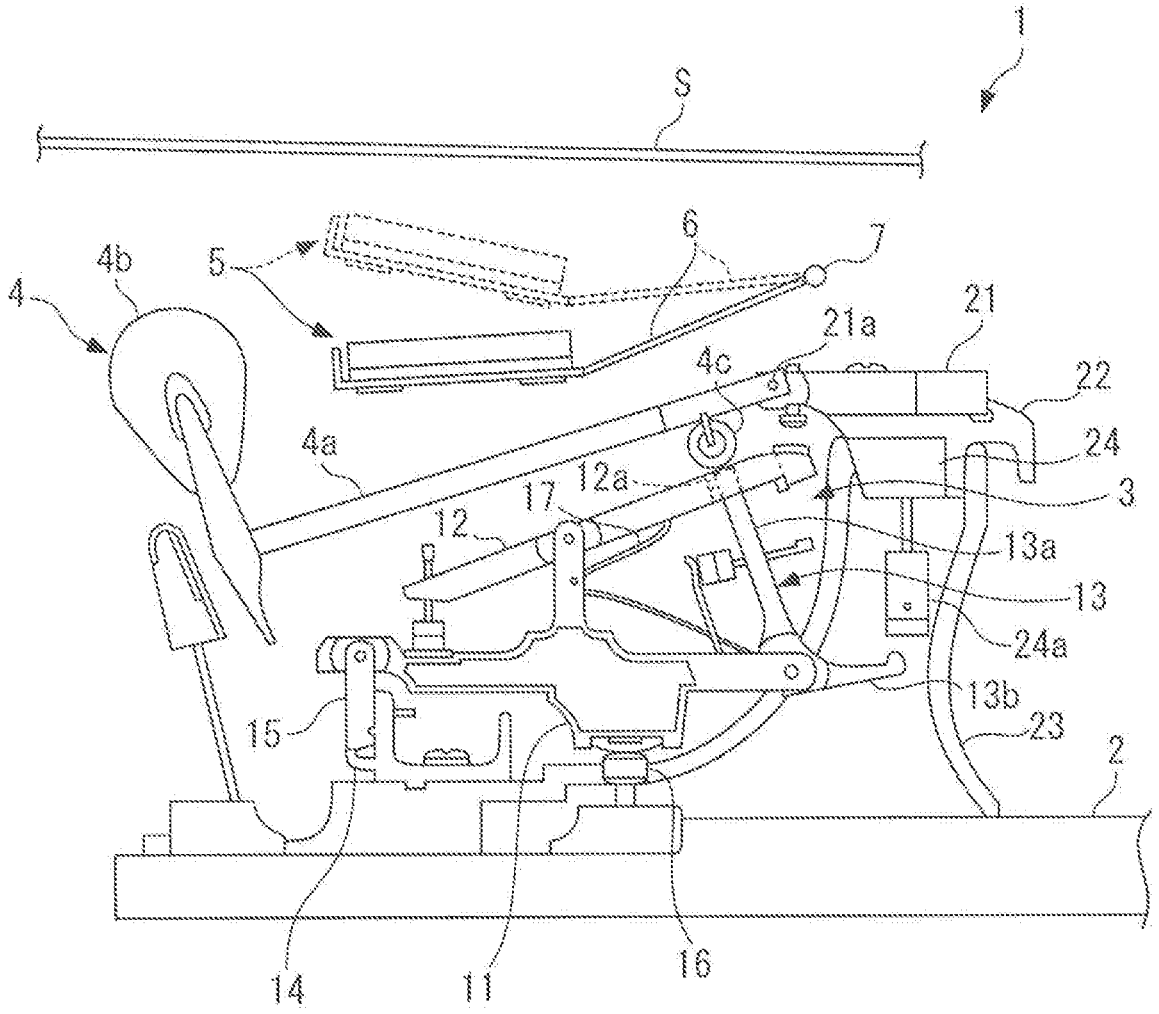
FIG. 1 is a side cross-sectional view of a keyboard apparatus of a grand silent piano to which a stopper rail according to a first embodiment of the present invention is applied, in a key-released state.
Figure 2:
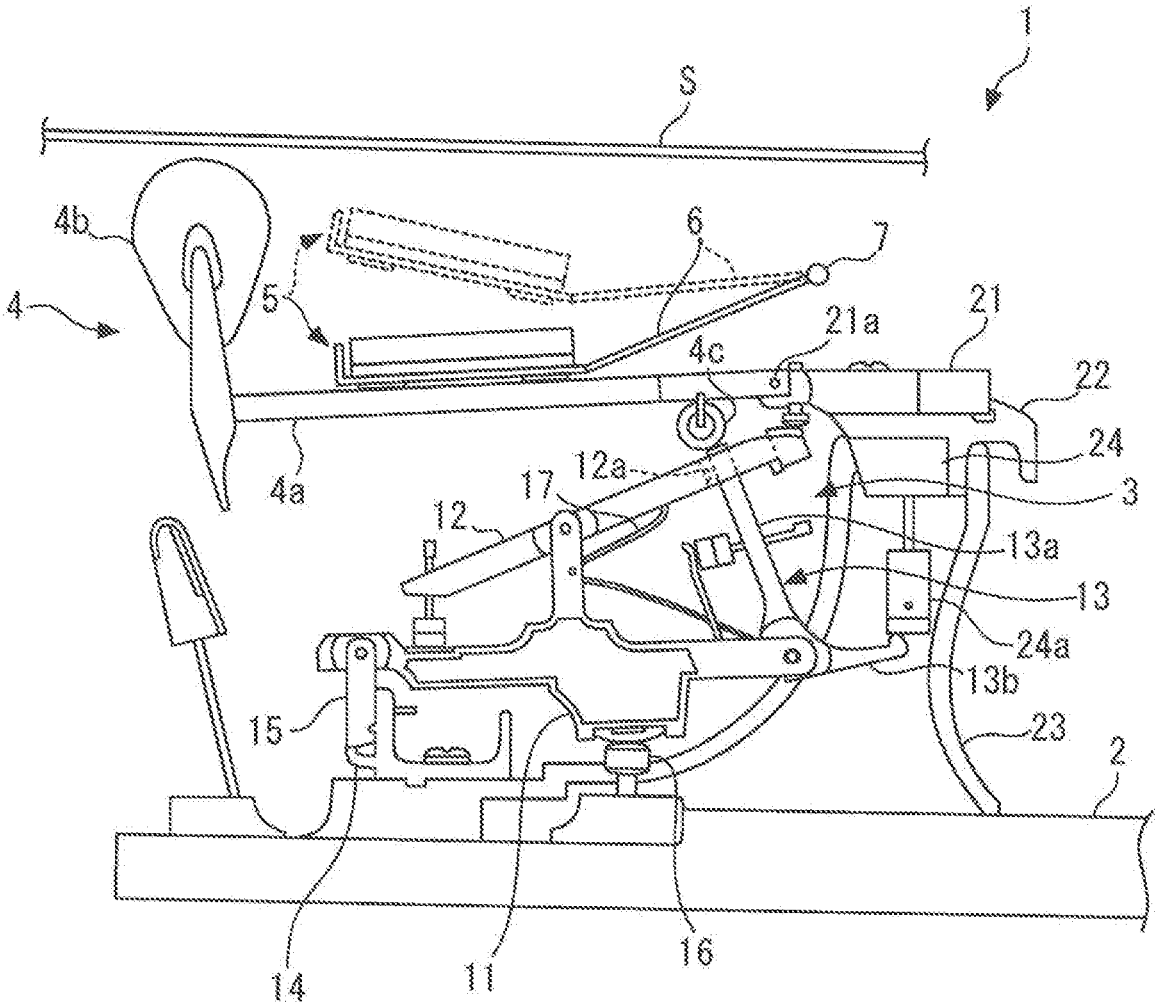
FIG. 2 is a side cross-sectional view of the keyboard apparatus in a key-depressed state.

The present invention will now be described in detail with reference to the drawings showing preferred embodiments thereof. FIGS. 1 and 2 show a keyboard apparatus of a grand silent piano to which a stopper rail according to a first embodiment of the invention is applied, in a key-released state and a key-depressed state, respectively. As shown in the two figures, the silent piano, denoted by reference numeral 1, includes a plurality of keys 2 (only one of which is shown) arranged in a state each extending in a front-rear direction (in a left-right direction as viewed in FIGS. 1 and 2) and located side by side in the left-right direction (in a depth direction as viewed in FIGS. 1 and 2), a plurality of actions 3 (only one of which is shown) provided in association with the keys 2, respectively, a plurality of hammers 4 (only one of which is shown) provided in association with the keys 2, respectively, for striking a string S from below by being driven upward by an associated action 3 which is operated in accordance with depression of an associated key 2, and a stopper rail 5 for blocking each string S from being struck by an associated hammer 4.

The silent piano 1 is configured such that it can be played while switching between a normal performance mode in which each hammer 4 is allowed to strike an associated string S to produce an acoustic piano tone and a silent performance mode in which the hammer 4 is blocked from striking the associated string S but a piano tone is output from an electronic sound source to headphones or the like.

Each key 2 is swingably supported on a balance rail pin (not shown) erected on a key frame (not shown) and extending in the front-rear direction, via a balance rail pin hole (not shown) provided in a center in the front-read direction or its vicinity thereof. Each string S is stretched on a frame, not shown, in a state extending substantially horizontally in the front-rear direction.

Each action 3 includes a wippen 11, a repetition lever 12 mounted on the wippen 11, and a jack 13. The wippen 11 is pivotally movably supported at its rear end by a wippen flange 15 fixed to a wippen rail 14 and is placed on a rear portion of the associated key 2 via a capstan screw 16.

The repetition lever 12 extends in the front-rear direction and has an central portion thereof pivotally movably counted on the wippen 11. Further, the repetition lever 12 is urged by a repetition spring 17 in an anticlockwise direction as viewed in FIG. 1. Further, the repetition lever 12 has a jack guide hole 12*a* vertically formed through a front portion thereof. A shank roller 4*c*, referred to hereinafter, is placed on the repetition lever 12 in a state covering the jack guide hole 12*a*.

The jack 13 is formed by a push-up portion 13*a* extending in a vertical direction and a contact portion 13*b* extending forward from a lower end of the push-up portion 13*a* such that it has an L shape in side view, and is pivotally movably mounted on the wippen 11 at a corner of the L shape. The push-up portion 13*a* of the jack 13 is inserted into the jack guide hole 12*a* of the repetition lever 12 from below such that it is opposed to the shank roller 4*c* with a gap. Further, the contact portion 13*b* of the jack 13 is opposed to a regulating button 24*a* from below with a predetermined distance.

In association with the keys 2 and the actions 3 constructed as described above, the hammers 4 are disposed in a state arranged side by side in the left-right direction. Each hammer 4 is comprised of the hammer shank 4*a* extending a predetermined length in the front-rear direction, a hammer head 4*b* attached to a rear end of the hammer shank 4*a*, and the shank roller 4*c* mounted on a front end of a lower surface of the hammer shank 4*a*. Further, the hammer 4 is pivotally movably supported by a hammer shank flange 21 at a front end of the hammer shank 4*a* such that it can be pivotally moved about a center pin 21*a*.

The hammer shank flange 21 is fixed to an upper surface of a shank rail 22 extending in the left-right direction (in the depth direction as viewed in FIGS. 1 and 2). Further, the shank rail 22 is mounted on a plurality of brackets 23 (only one of which is shown) arranged side by side in the left-right direction. The shank rail 22 has a regulating rail 24 integrally provided on a lower surface thereof, and the regulating rail 24 has a regulating button 24*a* provided thereon such that the regulating button 24*a* protrudingly extends downward.

The stopper rail 5 is disposed between the hammer shanks 4*a* of the hammers 4 and the strings S and is configured to have a predetermined length shorter than the hammer shanks 4*a* and extend a predetermined length in a direction of side-by-side arrangement of the hammers 4, i.e. in the left-right direction (in the depth direction in FIGS. 1 and 2). Further, the stopper rail 5 is connected to an arm 6 extending a predetermined length in the front-rear direction and is configured to be pivotally movable about a predetermined pivotal axis 7.

Further, the stopper rail 5 is retracted from a pivotally movable range of the hammer shank 4*a* by operation performed on a predetermined operation lever, not shown, whereby the stopper rail 5 is moved between a string striking-allowing position (position indicated by broken lines in FIGS. 1 and 2) and a string striking-blocking position (position indicated by solid lines in FIGS. 1 and 2). Note that the stopper rail 5 is either formed by a single stopper rail that extends in the left-right direction for all the hammers 4 arranged side by side in the left-right direction or by a plurality of (e.g. 4) divisional stopper rails each extending a predetermined length.

Figure 3:
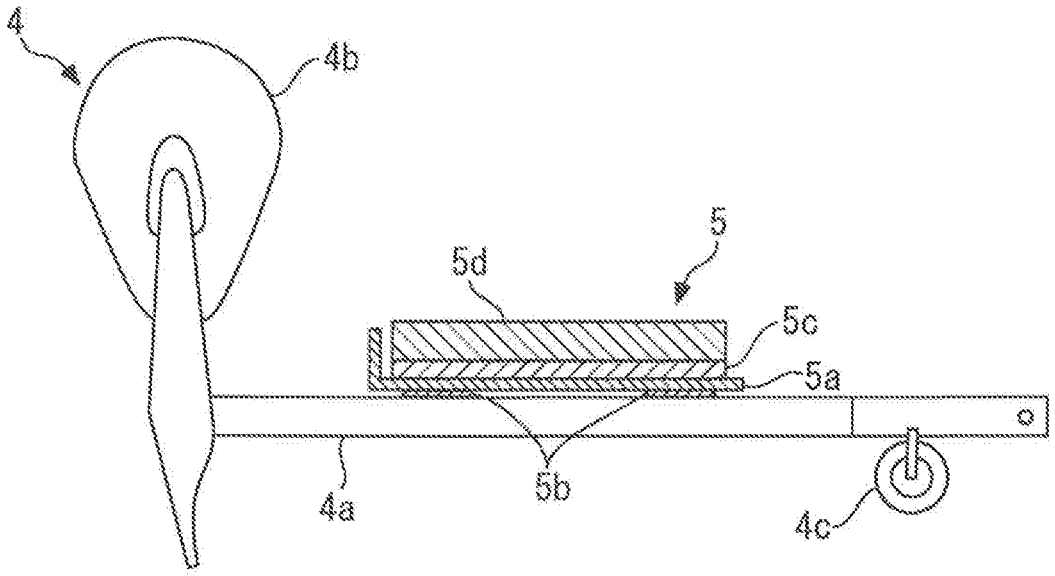
FIG. 3 is a side cross-sectional view of a hammer shank of a hammer, in a state brought into contact with the stopper rail.
Figure 4B:
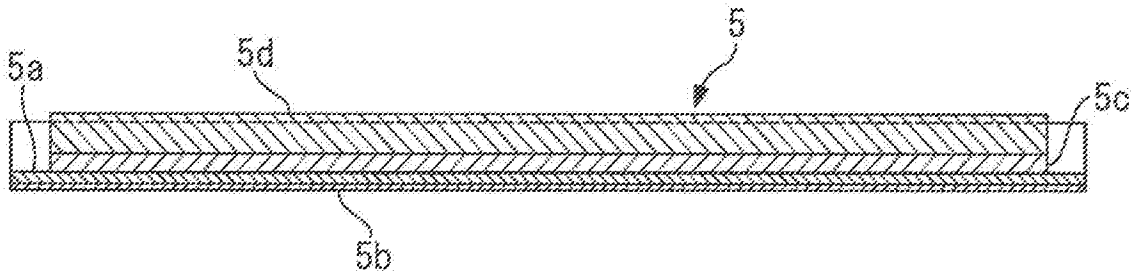
FIGS. 4A and 4B are a side cross-sectional view and a front view of the stopper rail in FIG. 3.
Figure 4A:
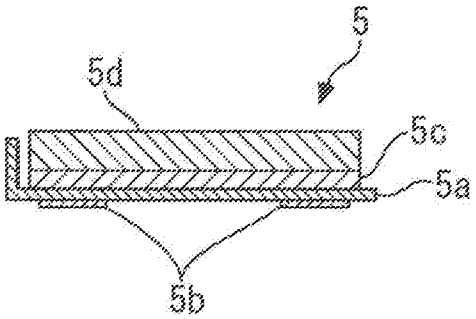

FIG. 3 shows the hammer shank 4*a* in a state in which the hammer shank 4*a* is brought into contact with the stopper rail 5 in the string striking-blocking position, from below, and FIGS. 4A and 4B are a side view and a front view of the stopper rail 5, respectively. Note that in FIG. 3, FIGS. 4A and 4B, hatching is given to laminated members of the stopper rail 5 for identification between them for convenience' sake.

As shown in FIG. 3, FIGS. 4A and 4B, the stopper rail 5 is comprised of a rail body 5*a*, cushions 5*b* (first cushion) which is provided on a lower surface (first surface) of the rail body 5*a* and with which the hammer shank 4*a* is brought into contact, and a weight 5*d* (vibration suppressing portion) which is provided on an upper surface (second surface) of the rail body 5*a* via a cushion 5*c* (second cushion). Note that in the following description, the above-mentioned cushions 5*b* and cushion 5*c* will be referred to as "the contact cushions 5*c*" and "the interposed cushion 5*c*".

The rail body 5*a* is formed by a metal plate which is made of iron or aluminum or the like and extends horizontally in the left-right direction with a predetermined thickness (e.g. 2 mm). Also, the rail body 5*a* is formed such that a rear end (left end in FIGS. 3 and 4A) thereof is bent upward. Further, the rail body 5*a* has a predetermined flexural rigidity allowing vibration. In other words, the hammer shank 5*a* itself is relatively low in flexural rigidity so that it is liable to vibrate depending on a manner of collision of the hammer shank 4*a*.

The contact cushions 5*b* are made of foamed urethane or a sound-absorbing material and are bonded to the lower surface of the rail body 5*a* as two front and rear members. Each contact cushion 5*b* has a predetermined thickness (e.g. 1 mm) and substantially the same length as that of the rail body 5*a*. Note that in the present embodiment, the contact cushions 5*b* and 5*b* are provided on the lower surface of the rail body 5*a* as the two front and rear members, a single contact cushion 5*b* may be provided on the entire lower surface of the rail body 5*a*.

On the other hand, the interposed cushion 5*c* is made of a resilient member, such as foamed urethane, and is bonded to a substantially entire upper surface of the rail body 5*a*.

The weight 5*d* is formed by a metal block made of iron or the like, which is horizontally long and extends in the left-right direction over substantially the same length as the rail body 5*a*, with a predetermined thickness and weight (e.g. 150 to 900 g). Therefore, since the weight 5*d* is disposed on an upper side of the rail body 5*a*, the gravity of the weight 5*d* acts as a load applied to the rail body 5*a* from above.

Here, operation of the above-described silent piano 1 in response to key depression will be described. As shown in FIGS. 1 and 2, when the key 2 is depressed, the wippen 11 is pivotally moved upward via the capstan screw 16, and the repetition lever 12 and the jack 13, which are attached to the wippen 11, are moved upward in unison with the wippen 11. In accordance with this movement, the push-up portion 13*a* of the jack 13 pushes up the hammer 4 via the shank roller 4*c*, whereby the hammer 4 is pivotally moved upward about the center pin 21*a*. Further, in this case, the contact portion 13*b* of the jack 13 is brought into contact with the regulating button 24*a*, whereby the jack 13 is restricted from moving upward, so that the jack 13 is pivotally moved clockwise with respect to the wippen 11 to leave the shank roller 4*c* (let-off). After the let-off, the hammer 4 is moved by inertia.

In the normal performance mode, the stopper rail 5 is in the string striking-allowing position indicated by broken lines in FIGS. 1 and 2. Therefore, the hammer shank 4*a* of the hammer 4 being pivotally moved upward is allowed to pass so that the hammer head 4*b* strikes the string S to produce an acoustic piano tone.

On the other hand, in the silent performance mode, the stopper rail 5 is in the string striking-blocking position indicated by solid lines in FIGS. 1 and 2. Therefore, as shown in FIG. 2, the hammer shank 4*a* of the hammer 4 being pivotally moved upward is brought into contact with the stopper rail 5, thereby blocking further pivotal movement of the hammer 4. As a result, the hammer head 4*b* is blocked from striking the string S so that no acoustic piano tone is produced.

Further, in the silent performance mode, noise generated when the hammer shank 4*a* of the hammer 4 being pivotally moved upward collides against the stopper rail 5 is relatively small and the sense of pitch thereof is blurred, so that, the noise is difficult to be recognized by the human ear.

More specifically, since the stopper rail 5 has the contact cushions 5*b* and 5*b* provided on the lower surface thereof as the two front and rear members, the hammer shank 4*a* is brought into contact with the rail body 5*a* via the contact cushions 5*b* and 5*b*. This makes it possible to reduce noise generated by collision of the hammer shank 5*a* compared with a case where the hammer shank 5*a* directly collides against the rail body 5*a*. Beside, for the stopper rail 5, the gravity of the weight 5*d* provided on the upper surface of the rail body 5*a* acts as a load on the rail body 5*a*. This suppresses vibration of the rail body 5*a* that is originally liable to vibrato, and although detailed experimental data is omitted, it was confirmed that the sense of pitch of collision noise generated when the hammer shank 4*a* collides against the stopper rail 5 is blurred and made difficult to be recognized by the human ear.

As described in detail heretofore, according to the stopper rail 5, it is possible to make the sense of pitch of collision noise generated when the hammer shank 4*a* collides against the stopper rail 5 blurred and difficult to be recognized by the human ear. As a result, it is possible to resolve the problem of obrusiveness of the collision noise to a person near the silent piano.

Figure 5B:
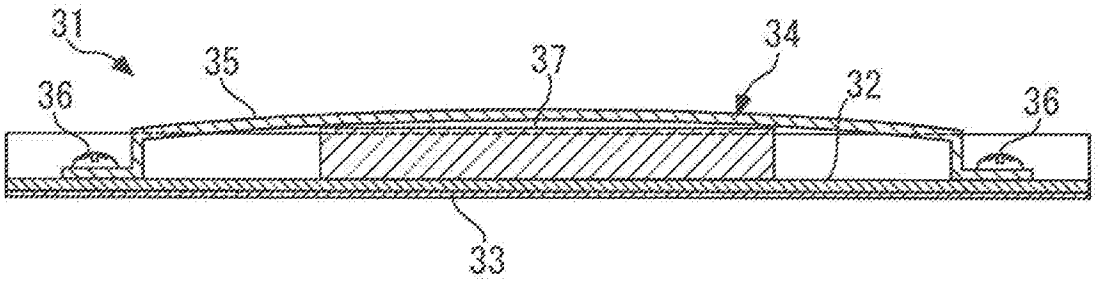
FIGS. 5A and 5B are a side view and a front view of a stopper rail according to a second embodiment of the present invention.
Figure 5A:
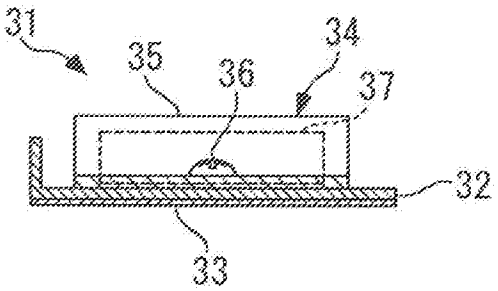

FIGS. 5A and 5B show a stopper rail 31 according to a second embodiment of the present invention. As shown in FIG. 5, the stopper rail 31 includes a rail body 32, a cushion 33 provided on a lower surface of the rail body 32, and a tension mechanism provided on an upper surface of the rail body 32 for causing tension to act on the rail body 32. Note that the rail body 32 and the cushion 33 of the stopper rail 31 are configured similar to the rail body 5*a* and the contact cushion 5*b* of the stopper rail 5 in the first embodiment described above.

The tension mechanism 34 includes a metal plate 35 (tension generating plate) that extends along a substantial entirety of the rail body 32 in a longitudinal direction of the rail body 32 and has opposite ends bent downward at right angles and further bent outward at right angles, a pair of fixing screws 36 and 36 for screwing the tension mechanism 34 to the opposite ends of the rail body, and an interposed block 37 (interposed portion) interposed between the rail body 32 and the metal plate 35. The interposed block 37 is not specifically limited in its material, but is only required to have such hardness as will not be crushed when the metal plate 35 is mounted on the rail body 32, described hereinafter. Note that in the present embodiment, the interposed block 37 is formed by wrapping a cushion, such as foamed urethane, around a wooden block.

The metal plate 35 has a predetermined height and the interposed block 37 is formed to be slightly higher than the above-mentioned height of the metal plate 3. With this, as shown in FIG. 5B, by fastening the two fixing screws 36 and 36 in a state in which the interposed block 37 is interposed between the rail body 32 and the metal plate 35, the metal plate 35 is bent convex upward when the opposite ends of the metal plate 35 are screwed to the opposite ends of the rail body 32. Then, a returning force of the bent metal plate 35 acts as tension on the rail body 32. Thus, it is possible to easily cause tension to act on the rail body 32 by cooperation of the metal plate 35 screwed to the rail body 32 and the interposed block 37 interposed therebetween.

As described above, by causing tension to act as a load on the rail body, it is possible to suppress vibration of the rail body 32 which is originally liable to vibrate and obtain the same operations and effects as in the first embodiment described above.

Note that the present invention is not limited to the above-described embodiments, but it can be practiced in various forms. For example, although in the above-described embodiments, the stopper rails 5 and 31 are applied to a grand silent piano, the present is not limited to this, but it can be applied to an upright silent piano. Further, details of the constructions of the stopper rails 5 and 32 shown in the embodiments are given only by way of example, and they can be changed as appropriate within the scope of the subject matter of the present invention.

What is claimed is:

1. A stopper rail for a silent piano that can be played while switching between a normal performance mode in which a hammer being pivotally moved in accordance with depression of a key is allowed to strike a string and a silent performance mode in which the hammer is blocked from striking the string, the stopper rail having a hammer shank of the hammer being pivotally moved brought into contact therewith to block further pivotal movement of the hammer, in the silent performance mode, the stopper rail comprising:

a rail body that extends in a direction of side-by-side arrangement of a plurality of the hammers of the silent piano and has a predetermined flexural rigidity allowing vibration;

a first cushion which is provided on a first surface of of the rail body on a side toward the hammer shank and with which the hammer shank is brought into contact; and a vibration suppressing portion which is provided on a second surface of the rail body opposite to the first surface so as to apply a load to the rail body, for suppressing vibration of the rail body when the hammer shank is brought into contact with the rail body.

2. The stopper rail according to claim 1, wherein the vibration suppressing portion extends along a substantial entirety of the rail body in a longitudinal direction of the rail body and has a weight causing gravity of the weight to act as the load on the rail body.

3. The stopper rail according to claim 2, wherein the vibration suppressing portion further includes a second cushion provided between the rail body and the weight.

4. The stopper rail according to claim 1, wherein the vibration suppressing portion has a tension mechanism that causes tension to act as the load on the rail body.

5. The stopper rail according to claim 4, wherein the tension mechanism includes:

a tension generating plate that extends along a substantial entirety of the rail body in a longitudinal direction of the rail body, for generating tension, a pair of fixing screws for screwing opposite ends of the tension generating plate to opposite ends of the rail body in the longitudinal direction of the rail body, respectively, and an interposed portion which is interposed between the rail body and the tension generating plate and cooperates with the tension generating plate by fastening of the pair of fixing screws to cause the tension to act on the rail body.

* * * * *